US008307647B2

(12) United States Patent
Le Flem et al.

(10) Patent No.: US 8,307,647 B2
(45) Date of Patent: Nov. 13, 2012

(54) INTERNAL COMBUSTION ENGINE ARRANGEMENT WITH EGR DRAIN SYSTEM

(75) Inventors: Loïc Le Flem, Millery (FR); Benoit Lombard, Lyons (FR)

(73) Assignee: Renault Trucks, St. Priest (FR)

( * ) Notice: Subject to any disclaimer, the term of this patent is extended or adjusted under 35 U.S.C. 154(b) by 397 days.

(21) Appl. No.: 12/808,221

(22) PCT Filed: Dec. 20, 2007

(86) PCT No.: PCT/IB2007/004417

§ 371 (c)(1),
(2), (4) Date: Jun. 15, 2010

(87) PCT Pub. No.: WO2009/081226

PCT Pub. Date: Jul. 2, 2009

(65) Prior Publication Data

US 2010/0263360 A1 Oct. 21, 2010

(51) Int. Cl.
*F02B 33/44* (2006.01)

(52) U.S. Cl. ..... 60/605.2; 60/602; 60/309

(58) Field of Classification Search ..... 60/605.2, 60/602, 309

See application file for complete search history.

(56) References Cited

U.S. PATENT DOCUMENTS

| | | | | |
|---|---|---|---|---|
| 6,367,256 | B1 | 4/2002 | McKee | |
| 6,978,772 | B1 * | 12/2005 | Dorn et al. | 123/568.12 |
| 2004/0079079 | A1 | 4/2004 | Martin | |
| 2007/0084206 | A1 | 4/2007 | Lew et al. | |

FOREIGN PATENT DOCUMENTS

| | | | |
|---|---|---|---|
| EP | 1548269 | A | 6/2005 |
| JP | 2005256679 | A | 9/2005 |

OTHER PUBLICATIONS

JP2006274961A (Abstract) Oct. 12, 2006.
JP7269417 (Abstract) Oct. 17, 1995.
JP2001193578A (Abstract) Jul. 17, 2001.
JP9242910 Sep. 16, 1997.
International Search Report for corresponding International Application PCT/IB2007/004417, Sep. 16, 2008.

* cited by examiner

*Primary Examiner* — Ching Chang
(74) *Attorney, Agent, or Firm* — WRB-IP LLP

(57) ABSTRACT

An internal combustion engine arrangement includes an EGR circuit connecting a exhaust circuit to an intake circuit to incorporate a portion of exhaust gases in the intake gases, at least one turbine located, and a dedicated drain conduit which connects the EGR circuit to the exhaust circuit. The EGR circuit includes at least one low position point and the dedicated drain conduit permanently connects the low position point of the EGR circuit to the exhaust circuit upstream of the turbine.

10 Claims, 1 Drawing Sheet

INTERNAL COMBUSTION ENGINE ARRANGEMENT WITH EGR DRAIN SYSTEM

BACKGROUND AND SUMMARY

The invention relates to an internal combustion engine arrangement having an exhaust gas recirculation (EGR) circuit.

As it is well know, an internal combustion engine may comprise a series of cylinders, an intake circuit for circulating intake gases to the cylinders and an exhaust circuit for collecting and evacuating exhaust gases from said cylinders. Many modern engines are now equipped with a turbo-charging system to enhance their efficiency, thereby having at least one turbine located in the exhaust circuit for recovering energy from the exhaust gases. For reasons mainly related to a better control of noxious emissions by the engine, it is well known to equip the engine with an EGR circuit connecting the exhaust circuit to the intake circuit to incorporate a portion of exhaust gases in the intake gases.

The portion of the exhaust gases which circulate in the EGR circuit, which will be referred to hereinafter as EGR gases, are those gases which result from the combustion of the air/fuel mixture in the cylinders. EGR gases comprise mainly carbon dioxide and water, but may also comprise nitrogen oxides, un-burnt hydrocarbons, carbon monoxide and other residues such as particles and soot. Among all these components, water is certainly the least harmful component in terms of pollution, but it nevertheless raises some difficulties. Indeed, it has appeared that at least in some EGR circuit designs, the water contained in the EGR gases, initially under vapor form due to the temperature of the exhaust gases, may condense in the EGR circuit. Of course, the risk is maximum in engine arrangements where the EGR circuit comprises a cooler to cool down the EGR gases before they are introduced in the intake circuit, and it is of particular relevance when the engine has not reached its full operating temperature, while starting and/or under cold temperatures.

The amount of water which may condense will vary according to the engine design, but also depending on the type of fuel burnt in the engine. Although water condensation may happen in petrol engines, in Diesel engines and in gas engines, it has proved to be particularly important in the case of gas engines, simply because the amount of water produced by the combustion of gas is proportionally more important than with other fuels.

Water condensation in the EGR circuit may lead to undesired results. First, the water will tend to accumulate at any low position point in the EGR circuit, that is any point of the circuit which has an altitude lower than its neighboring points on both sides. It is to be noted that a given circuit may comprise several low position points. Such low position points may be in a conduit portion of the circuit, in a cooler assembly or can be located at a valve level when the valve is closed. The amount of water which may condense can be quite important, especially during engine start-up.

If the accumulated water is still present when the engine is shut down, it will stay at least until next start-up, and may cause corrosion issues at the low position point. Another potential problem is that, at certain times, a quantity of accumulated water may burst into the intake circuit and be fed, still under liquid form, to the cylinders. If the amount of water thus fed to the cylinders is not insubstantial, it may severely affect the combustion process, resulting in engine jerk and increased production of noxious compounds in the cylinder.

In order to prevent such problems, it has already been suggested to equip the EGR circuit with drain systems to prevent or at least remove accumulated water.

Document JP-2001.193578 discloses an EGR circuit having a drain valve. The drain valve is a normally-open ball valve where the ball is spring-biased to the open position in the absence of pressure in the EGR circuit, so as to permit condensed water to escape. As soon as the EGR circuit is under pressure, the ball valve is automatically closed. Such a pressure controlled valve does not allow accumulated water to be drained when the EGR circuit is in use. The drain valve is arranged at a low position point in the EGR circuit, very close the exhaust circuit, and when the valve is opened, it discharges directly in the atmosphere, which is of course not optimum due to the fact that noxious substances may be discharged to the atmosphere, amounting to pollution Documents JP-7.269417 and JP-8.46964 both disclose an EGR circuit with a condensed-water collector which can be drained through a dedicated controlled purge valve. The valve discharges directly to the atmosphere, with the above mentioned pollution problem, and this dedicated controlled valve represents an increased cost.

Document JP-2005.256.679 shows an engine having an engine arrangement where a dedicated controlled drain valve is provided at a low position point in the intake circuit between the EGR mixer and the intake manifold.

Document JP-2006-274961 shows an EGR circuit with a dedicated drain conduit which connects the EGR circuit to the exhaust circuit and which is equipped with a cyclone-type gas/water separator having a dedicated controlled drain valve. The separator is of course a cumbersome apparatus, also representing an additional cost in addition to the cost of the dedicated controlled valve.

Document US-2007/0084206 also shows an EGR circuit with a dedicated drain conduit which connects the EGR circuit to the exhaust circuit and which has a dedicated controlled drain valve, with one embodiment having the drain valve combined with the conventional EGR valve as a three way valve. As in the previous document, the drain valve is connected to the exhaust circuit downstream of the turbine of a turbo-compressor. In the latter document, the drain valve appears to be only opened when the EGR valve is closed, so that no draining appears to be possible when the EGR is required.

In view of the above, it appears the there is still the need for a cheap solution to the problem of water accumulation which nevertheless does not cause unnecessary pollution of the ambient air and may nevertheless operate in a wide range of engine operating conditions.

An aspect of the invention provides for an internal combustion engine comprising:

- an EGR circuit (32) connecting a exhaust circuit (20) to an intake circuit (16) to incorporate a portion of exhaust gases in the intake gases,
- at least one turbine (26) located; and
- a dedicated drain conduit (46) which connects the EGR circuit (32) to the exhaust circuit (20);

characterized in that the EGR circuit comprises at least one low position point and in that the dedicated drain conduit permanently connects said low position point of the EGR circuit to the exhaust circuit upstream of said turbine.

According to other features of an engine arrangement:

- the engine may comprise one or several cylinders;
- the intake circuit is designed for circulating intake gases to the cylinder(s);
- the exhaust circuit is designed for collecting and evacuating exhaust gases from said cylinder(s):

the turbine located in the exhaust circuit is designed for recovering energy from the exhaust gases.

DETAILED DESCRIPTION

Figure 1:
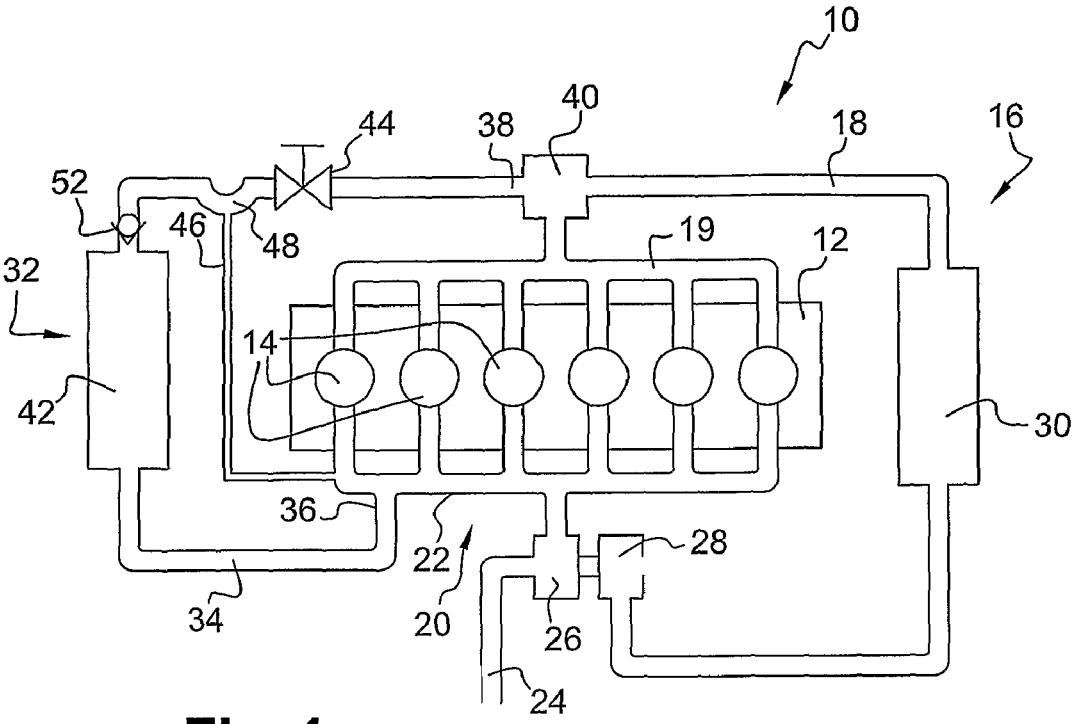
FIG. 1 is a schematic diagram of an engine arrangement according to the invention.

FIG. 1 very schematically shows an internal combustion engine arrangement 10 having an engine block 12 comprising as series of cylinders 14, which could be of any number, the invention being also applicable in the case of a mono-cylinder engine. An intake circuit 16, comprising an intake conduit 18 and an intake manifold 19, provides the engine cylinders with intake gases. An exhaust circuit 20, comprising an exhaust manifold 22 and an exhaust conduit 24 collects the exhaust gases which result from the combustion of the intake gases in the cylinders 14. According to the invention, the engine further comprises at least one turbine 26 located in the exhaust circuit 20 to recover a part of the energy contained in the exhaust gases.

According to a preferred embodiment of the invention, the arrangement 10 comprises also a compressor 28 in the intake circuit to compress the intake gases which are fed to the cylinders 14.

In the described embodiment of the invention, the engine is a turbocharged engine wherein the turbine 26 in the exhaust circuit drives the compressor 28 in the intake circuit. Nevertheless, the invention could also be applied in an arrangement where the turbine drives another apparatus, such as an electric generator or a gear train of a turbo-compound system. Similarly, the preferred embodiment of the invention could comprise a compressor 28 driven not by the turbine 26 but driven mechanically by the engine crankshaft. The engine could also comprise other compressors and/or other turbines located upstream or downstream of the above mentioned compressor 28 and turbine 26.

Depending on the engine arrangement, such as on the type of fuel burnt by the engine, and on whether fuel injection is of the direct type or indirect type, the intake circuit may comprise various additional components. For example, in the represented embodiment, the intake circuit comprises a charge air cooler 30 for cooling the intake gas. The charge air cooler 30 is located in the intake conduit between the compressor 28 and the intake manifold. Similarly, depending on the engine arrangement, the exhaust circuit 20 may comprise additional components, not shown on the figure, especially components dedicated to the treatment of the exhaust gases to reduce their noxiousness and to reduce the noise they may generate. The exhaust manifold could be divided in sub-manifolds, each dedicated to only one group of cylinders.

The engine arrangement according to the invention also comprises an EGR circuit 32. The EGR circuit shown on FIG. 1 comprises an EGR conduit 34 which is fluidly connected by an upstream extremity 36 to the exhaust circuit 20 and, by a downstream extremity 38, to the intake circuit 16 in order to provide a part of the exhaust gases, hereinafter called EGR gases, to the intake circuit to be incorporated in the intake gases fed to the cylinders. The downstream extremity 38 of the EGR conduit is connected to the intake circuit 16 through an EGR mixer 40 where the EGR gases are mixed to intake air to form the intake gases. In the example, shown, the EGR mixer 40 is located downstream of the compressor 28, but it could also be located upstream of said compressor. In the shown embodiment of the invention, the Upstream extremity 36 of the EGR conduit 34 is connected to the exhaust circuit upstream of the turbine 26. In this case, it is directly connected to the exhaust manifold 22. Such a design for an EGR circuit is sometimes called short route design or high pressure design. Nevertheless, the invention is also applicable in the case of a long-route/low-pressure design where the exhaust gases are collected downstream of the turbine and reintroduced in the intake circuit upstream of the compressor, or in the case of a hybrid design, such as where the exhaust gases are collected upstream of the turbine and reintroduced in the intake circuit upstream of the compressor.

The EGR circuit shown on the figures also comprises an EGR cooler 42, to cool down the EGR gases, and an EGR valve 44 to control the flow of EGR gases in the EGR circuit, thereby controlling the composition of the intake gases. In the shown embodiment, the valve 44 is located on the EGR conduit downstream of the EGR cooler 42, but the reverse implementation is also possible. The EGR circuit 32 further comprises a dedicated drain conduit 46 which connects the EGR circuit to the exhaust circuit 20.

According to the invention, the EGR circuit 32 comprises at least one low position point 48, and the dedicated drain conduit 46 permanently connects said low position point 48 of the EGR circuit 32 to the exhaust circuit 20 upstream of the turbine 26 to evacuate condensed water or more generally any liquid material present at low position point 48.

In the described embodiment of the invention, the low position point 48 is located in the EGR circuit between the EGR cooler 42 and the EGR valve 44. When the EGR circuit is equipped with a cooler, this location downstream of the cooler is particularly advantageous because condensation is most likely to appear in the cooler or just downstream of the cooler. The low position point could be inside the cooler itself. Also, the location of the low position point upstream of the EGR valve is very advantageous because it implies that the drain circuit remains connected to the EGR circuit even when the EGR valve 44 is closed. Of course, this feature is even more advantageous in a configuration where, as in the shown embodiment, the EGR valve is located in a downstream portion of the EGR circuit, near its connection to the intake circuit, and downstream of the EGR cooler, if any. Indeed, it is then possible to have a low position point in one of the coldest part of the EGR circuit, where condensation is most likely, while keeping the advantage of the permanent connection of the drain conduit with the EGR circuit.

It must be understood that the EGR circuit may comprise several low position points. In such a case, it is possible to equip several or all of them with a drain device, but it is also possible to equip only one of them with such device if only one of them is really prone to water accumulation. Indeed if the EGR circuit has a low position point near its upstream extremity 36; the risk of having any substantial water accumulation in such a location is fairly small, because such a location will be very quickly heated by the exhaust gases.

The low position point 48 where the drain conduit 46 is connected to the EGR circuit can be located at a bottom point of a specifically designed water accumulating chamber, or it can just be a location implied by the other constructional constraints of the arrangement and by the ordinary design of an EGR circuit.

In the shown embodiment, the drain conduit is connected to the exhaust circuit 20 directly on the exhaust manifold 22 which, in most cases, will be the hottest spot of the exhaust circuit. This ensures that the water drained through conduit 46 is efficiently vaporized as soon as it enters the exhaust circuit almost at all times.

In one embodiment of the invention, the drain system may rely on gravity to evacuate accumulated water at the low position point 48 towards the exhaust circuit. Therefore, it has to be provided that the drain conduit has its connection to the EGR circuit at a higher level than its connection to the exhaust circuit, and that it itself has no intermediate low position point.

Nevertheless, it can also be provided that the evacuation of accumulated water may be assisted by the pressure of gases in the system.

Figure 2:
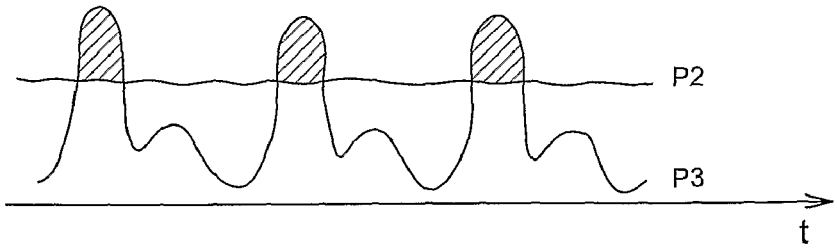
FIGS. 2 and 3 are schematic graphs showing the comparative pressure levels in the intake and exhaust manifolds of an internal combustion engine, for two sets of engine operating conditions.
Figure 3:
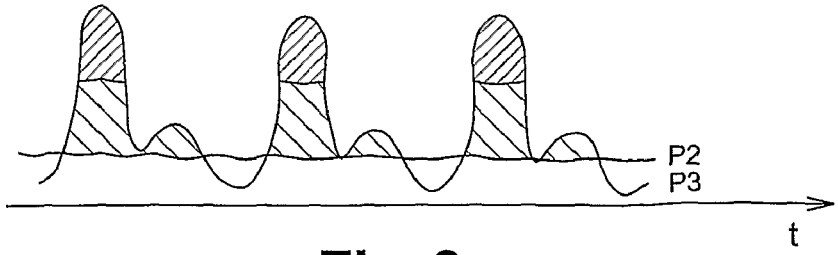

On FIG. 2 is shown a diagram showing an exemplary comparison of the variation over time of the pressure P2 in the intake manifold and of the pressure P3 in the exhaust manifold of a turbo-compressed internal combustion engine. Such a diagram is valid for a given set of operating conditions, corresponding to rather low engine load conditions. FIG. 3 represents the same diagram but for rather high load/high speed engine conditions.

As can be seen, the pressure P2 in the intake manifold is quite constant for such a given state of operation of the engine. To the contrary, the pressure P3 varies over time, with pressure peaks which correspond to the opening of the exhaust valve(s) of the cylinders. Of course, pressure variations at locations more downstream in the exhaust circuit are smoothened.

In the set of operation for which the diagrams of FIGS. 2 and 3 are true, the pressure P3 in the exhaust manifold is sometimes lower than the pressure in the intake manifold, but is higher than the pressure in the intake manifold when the exhaust manifold pressure reaches its peak levels corresponding to the opening of the exhaust valve(s). To ensure that the EGR circuit may operate under such conditions, i.e. to ensure that exhaust gases are nevertheless incorporated in the intake gases, it is known to equip the EGR circuit with a check valve system as symbolically depicted under reference 52 in FIG. 1. Such a system can be of the type described in document EP-1.098.085 and is also referred to as a reed valve. Such a system is preferably located downstream of the EGR cooler when the EGR circuit is so equipped. Such a check valve system permits the flow of EGR from the exhaust circuit to the intake circuit when pressure differential is favorable (peak pressures in exhaust manifold) and prevents any backflow otherwise.

In such a design, it may therefore be useful to provide that the low position point 48 of the EGR circuit 32 to which the drain conduit 46 is connected is situated downstream of the check valve system 52 and upstream of the EGR valve 44. Indeed, when the EGR valve is open, pressure at the low position point will never be lower than the pressure P2 in the intake manifold. Therefore, when pressure P3 in the exhaust manifold falls below that pressure level, the pressure differential between each extremities of the drain circuit will at least assist the flow of water from the EGR circuit towards the exhaust circuit. When the EGR valve is closed, the check valve system 52 will tend to create a pressure accumulation in the portion of the conduit 34 between the check valve system 52 and the EGR valve 44. Therefore, when pressure P3 in the exhaust manifold falls below that pressure level, the pressure differential between each extremities of the drain circuit will at least assist the flow of water from the EGR circuit towards the exhaust circuit.

In such a design, where pressure differentials are used to assist the evacuation of water through the drain conduit 46, it will be possible to provide a drain conduit of lesser diameter, and it may also allow more freedom of design with respect of the height level differential between both extremities of the drain circuit, compared to a design relying only on gravity for evacuating the condensed water. The use of a small diameter drain conduit is advantageous in that it will minimize the amount of EGR gases which may flow through said conduit. Indeed, it is to be noted that the drain conduit is devoid of any valve and that the connection it establishes between the low position point of the EGR circuit and the exhaust circuit is therefore permanent in both directions. Therefore, in the absence of condensed water, some amount of EGR gases may circulate through the drain conduit 46, at least when the EGR valve 44 is open. Depending on the pressure differential at both extremities of the drain conduit, this may result either in a parallel flow of EGR gases (un-cooled even if the EGR circuit is equipped with EGR cooler 42), or in a back-flow of gases from the EGR circuit to the exhaust circuit.

A direct advantage of the drain circuit according to the invention not having any valve therein is of course the cost saving in comparison with previous systems, especially with systems having a controlled valve because of the additional cost of the control system. Another advantage is the reliability of the system, because it has no moving part and no electronic part. Also, the system not only permits the draining of accumulated water, it also strongly limits any substantial water accumulation because of the permanent connection of the low position point with the exhaust circuit, contrary to the prior art where the connection is established only at certain times. Moreover, the system according to the invention does not interfere at any time with the functioning of the EGR system and does not cause any undesired and uncontrolled pollution. Therefore, the system according to the invention will bring many advantages, especially in engine arrangements which are more prone to water condensation in the EGR circuit, such as gas engines.

The invention claimed is:

1. An internal combustion engine arrangement comprising:

an EGR circuit connecting a exhaust circuit to an intake circuit (16) to incorporate a portion of exhaust gases in the intake gases, at least one turbine located; and a dedicated drain conduit which connects the EGR circuit to the exhaust circuit;

wherein the EGR circuit comprises at least one low position point and in that the dedicated drain conduit permanently connects the low position point of the EGR circuit to the exhaust circuit upstream of the turbine.

2. An arrangement according to claim 1, wherein the dedicated drain conduit is connected to the exhaust circuit at a location of lower altitude than that of the low position point of the EGR circuit.

3. An arrangement according to claim 2, wherein liquid material may circulate by gravity from the EGR circuit to the exhaust circuit through the drain conduit.

4. An arrangement according to claim 1, wherein the exhaust circuit comprises an exhaust manifold collecting exhaust gases from several cylinders into one exhaust conduit, and the drain conduit is connected to the exhaust manifold.

5. An arrangement according to claim 1, wherein the intake circuit comprises at least one compressor, and in that the EGR circuit is connected to the intake circuit downstream of the at least one compressor, in that the EGR circuit comprises a check valve system whereby gases may circulate in the EGR circuit only from the exhaust circuit towards the intake circuit, and the low position point, where the drain conduit is connected to the EGR circuit, is located downstream of the check valve system.

6. An arrangement according to claim 5, wherein the EGR circuit comprises a cooler for cooling the gases circulating in the EGR circuit, and the low position point, where the drain conduit is connected to the EGR circuit, is located in the cooler or downstream of the cooler, and the check valve system is located downstream of the EGR cooler.

7. An arrangement according to claim 5, wherein the EGR circuit comprises, in that order, an EGR cooler, the check valve system, the low position point and an EGR valve.

8. An arrangement according to claim 1, wherein the EGR circuit comprises a cooler for cooling the gases circulating in the EGR circuit, and the low position point, where the drain conduit is connected to the EGR circuit, is located in the cooler or downstream of the cooler.

9. An arrangement according to claim 8, wherein the EGR circuit comprises an EGR valve, and the low position point, where the drain conduit is connected to the EGR circuit, is located upstream of the EGR valve, and the EGR valve is located downstream of the EGR cooler, the low position point being in between.

10. An arrangement according to claim 1, wherein the EGR circuit comprises an EGR valve, and the low position point, where the drain conduit is connected to the EGR circuit, is located upstream of the EGR valve.

* * * * *